United States Patent [19]

Ko et al.

[11] 4,189,848

[45] Feb. 26, 1980

[54] ENERGY-EFFICIENT REGENERATIVE LIQUID DESICCANT DRYING PROCESS

[75] Inventors: Suk M. Ko; Philomena G. Grodzka, both of Huntsville; Paul O. McCormick, Athens, all of Ala.

[73] Assignee: The United States of America as represented by the Department of Energy, Washington, D.C.

[21] Appl. No.: 821,868

[22] Filed: Aug. 4, 1977

[51] Int. Cl.[2] ..... F26B 3/00

[52] U.S. Cl. ..... 34/32; 34/80; 34/93; 126/433; 126/934; 126/435

[58] Field of Search ..... 34/32, 80, 126, 169, 34/224, 270; 237/1 A; 126/270, 271

[56] References Cited

U.S. PATENT DOCUMENTS

| | | | |
|---|---|---|---|
| 3,585,379 | 6/1971 | Yamamoto et al. | 362/806 |
| 3,972,129 | 8/1976 | Graff | 34/32 |
| 4,125,946 | 11/1978 | Prager | 34/80 |
| 4,148,147 | 4/1979 | Steffen | 34/32 |

*Primary Examiner*—Benjamin R. Padgett
*Assistant Examiner*—J. L. Barr
*Attorney, Agent, or Firm*—R. V. Lupo; Robert M. Poteat; Louis M. Deckelmann

[57] ABSTRACT

This invention relates to the use of desiccants in conjunction with an open loop drying cycle and a closed loop drying cycle to reclaim the energy expended in vaporizing moisture in harvested crops. In the closed loop cycle, the drying air is brought into contact with a desiccant after it exits the crop drying bin. Water vapor in the moist air is absorbed by the desiccant, thus reducing the relative humidity of the air. The air is then heated by the used desiccant and returned to the crop bin. During the open loop drying cycle the used desiccant is heated (either fossil or solar energy heat sources may be used) and regenerated at high temperature, driving water vapor from the desiccant. This water vapor is condensed and used to preheat the dilute (wet) desiccant before heat is added from the external source (fossil or solar). The latent heat of vaporization of the moisture removed from the desiccant is reclaimed in this manner. The sensible heat of the regenerated desiccant is utilized in the open loop drying cycle. Also, closed cycle operation implies that no net energy is expended in heating drying air.

7 Claims, 9 Drawing Figures

ENERGY-EFFICIENT REGENERATIVE LIQUID DESICCANT DRYING PROCESS

BACKGROUND OF THE INVENTION

This invention was made in the course of, or under a contract with the U.S. Energy Research and Development Administration.

The United States produces large volumes of crops for food and livestock feed every year. These crops require drying before temporary or long term storage. The degree of crop drying depends upon the condition of the crop at harvest and the intended end use for the crop. Energy required to dry crops using conventional crop drying equipment is typically about 2200 Btu per pound of water removed from the crop. The 2200 Btu includes energy required for blowers to circulate air as well as the thermal energy used to heat the drying air and the crop. Considering just the grain crops, an estimate of the annual energy requirement for drying crops may be made assuming that roughly 10% of weight of the harvested grain crops is excess moisture which must be removed and using 60 lb. as a weight equivalent for one bushel of grain. An energy requirement of $1.2\times10^{14}$ But would be expended annually if the total harvest of grain crops were submitted to drying.

Conventional crop drying equipment dries crops in an open loop cycle wherein ambient air is heated to decrease the relative humidity of the air and then drives the heated, low humidity air through the crop where moisture is absorbed from the crop. The air is then expended to the atmosphere and carries with it the energy used to vaporize moisture in the crop and that used to increase the air temperature.

Thus, the energy requirements for crop drying is substantial and, in view of potential shortages in fossil fuel energy sources, concepts for conserving energy expenditures for crop drying are desirable.

The present invention was conceived to meet this need in a manner to be described hereinbelow.

SUMMARY OF THE INVENTION

It is the object of the present invention to provide a method and apparatus for the drying of harvested crops in such a manner that a substantial saving in the required energy therefor is effected.

The above object has been accomplished in the present invention by utilizing desiccants in conjunction with an open loop drying cycle and a closed loop drying cycle to reclaim the energy expended in vaporizing moisture in harvested crops. In the closed loop cycle, the drying air is brought into contact with a desiccant after it exits a crop drying bin. Water vapor in the moist air is absorbed by the desiccant, thus reducing the relative humidity of the air. The air is then heated by the used desiccant and returned to the crop bin. During the open loop drying cycle the used desiccant is heated and regenerated at high temperature, driving water vapor from the desiccant. This water vapor is condensed and used to preheat the dilute (wet) desiccant before heat is added from the external source. The latent heat of vaporization of the moisture removed from the desiccant is reclaimed in this manner, and the sensible energy contained in the regenerated hot desiccant is used in the open loop drying cycle after which it is then recycled through the closed loop as many times as desired until the crop in the drying bin has been dried to a desired state.

DESCRIPTION OF THE PREFERRED EMBODIMENTS

Desiccants are hygroscopic chemical substances that have large affinity for water. Although desiccants remove water by a variety of mechanisms, the action of many desiccants may be understood in terms of water vapor partial pressure. Due to the difference in the partial pressure of water vapor in the desiccant and the material to be dried water will deffuse from the material being dried to the desiccant until a dynamic equilibrium is reached. This occurs when the two substances attain the same partial pressure of water. At this point no net transfer of water takes place. The performance of the desiccant may be evaluated in terms of efficiency and capacity that are defined as follows. Drying efficiency is the fraction of total water input that the desiccant removes. Drying capacity is the quantity of water that a unit mass of desiccant can take up before losing drying efficiency.

Examples of liquid desiccants that can be utilized in the present invention include deliquescent salt solutions such as calcium chloride or lithium chloride in water as well as organic compounds such as glycol, glycerine and sulfuric acid. These are all liquid at all ordinary ranges of temperature and dilution. When in solution, deliquescent compounds will obviously have lower drying efficiency and capacity than the same anhydrous salt, but the much greater ease of handling the liquid solution makes the solutions preferable where very low humidities are not required as is the case in crop drying. The anhydrous liquids (glycol for example) can produce nearly complete dehydration, but large quantities of the drying agent must be used due to low drying capacity, and complete regeneration is usually difficult. One of the greatest advantages of the liquids is that a desired relative humidity of the drying air can be maintained with very close control regardless of inlet moisture conditions. This is accomplished by simply maintaining the dehydration solution at the proper concentration and temperature or by varying the flow rate of the desiccant.

Figure 1A:
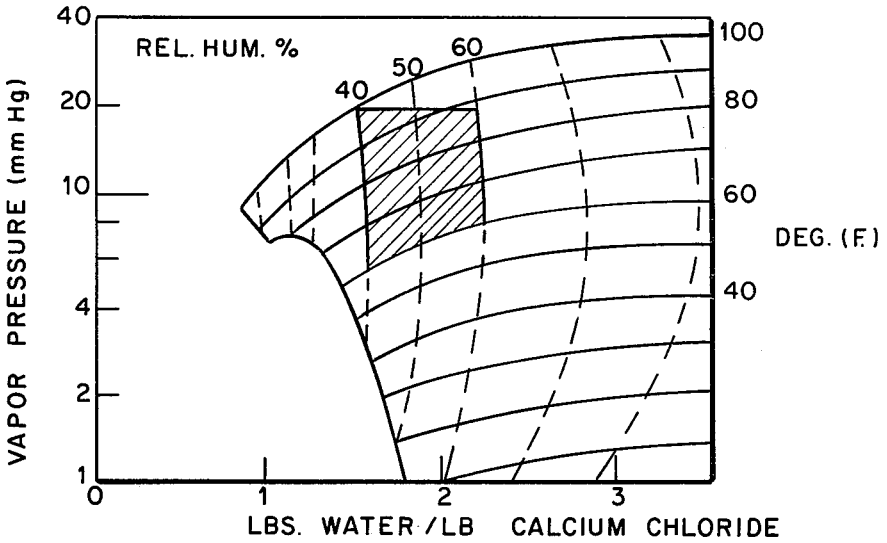
FIG. 1*a* is a graph illustrating the operating range of calcium chloride when it is utilized as a desiccant.
Figure 1B:
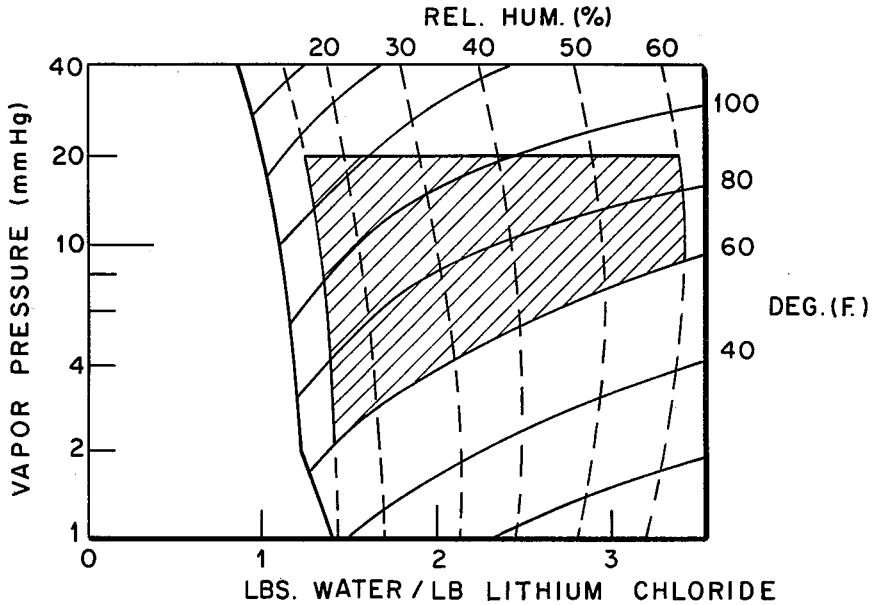
FIG. 1*b* is a graph illustrating the operating range of lithium chloride when it is utilized as a desiccant.
Figure 2A:
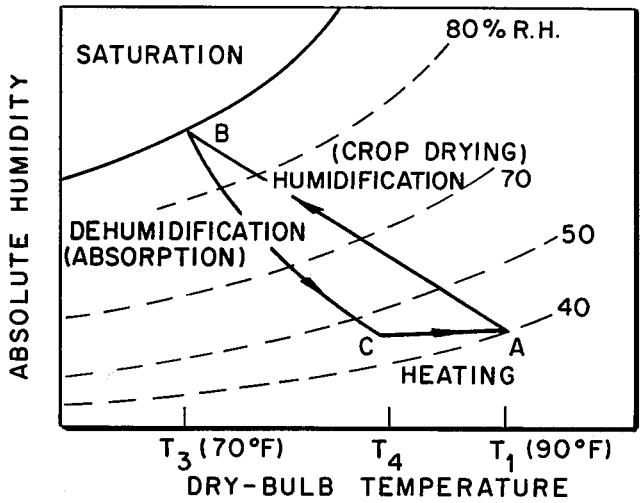
FIG. 2*a* is a graph illustrating the closed loop drying cycle of one system of the present invention.
Figure 2B:
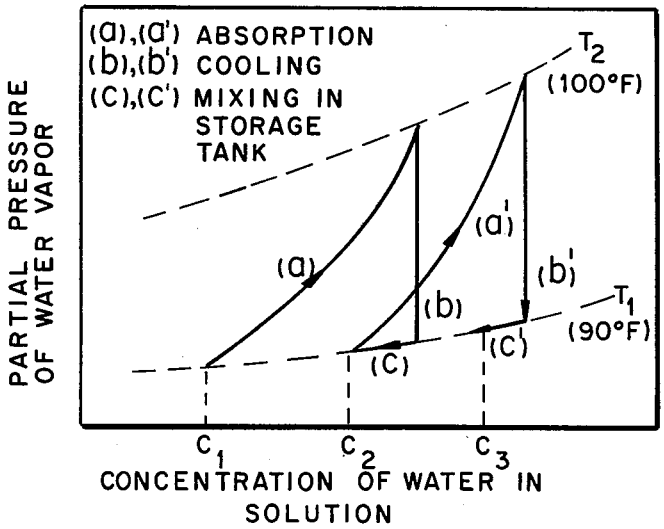
FIG. 2*b* is a graph illustrating the corresponding changes in the desiccant concentration and temperature with respect to FIG. 2*a;*

Since glycerine is sensitive to thermal decomposition and must be regenerated in vacuum, and sulfuric acid and glycol are toxic, the preferred liquid desiccants are lithium chloride and calcium chloride solutions. However, it can be seen from FIG. 1*a* of the drawings that the operating range of calcium chloride, illustrated by the shaded area thereof, is substantially limited compared to that of lithium chloride as illustrated by the shaded area of FIG. 1*b*, such that the lithium chloride is the preferred desiccant of these two salts.

Figure 4:
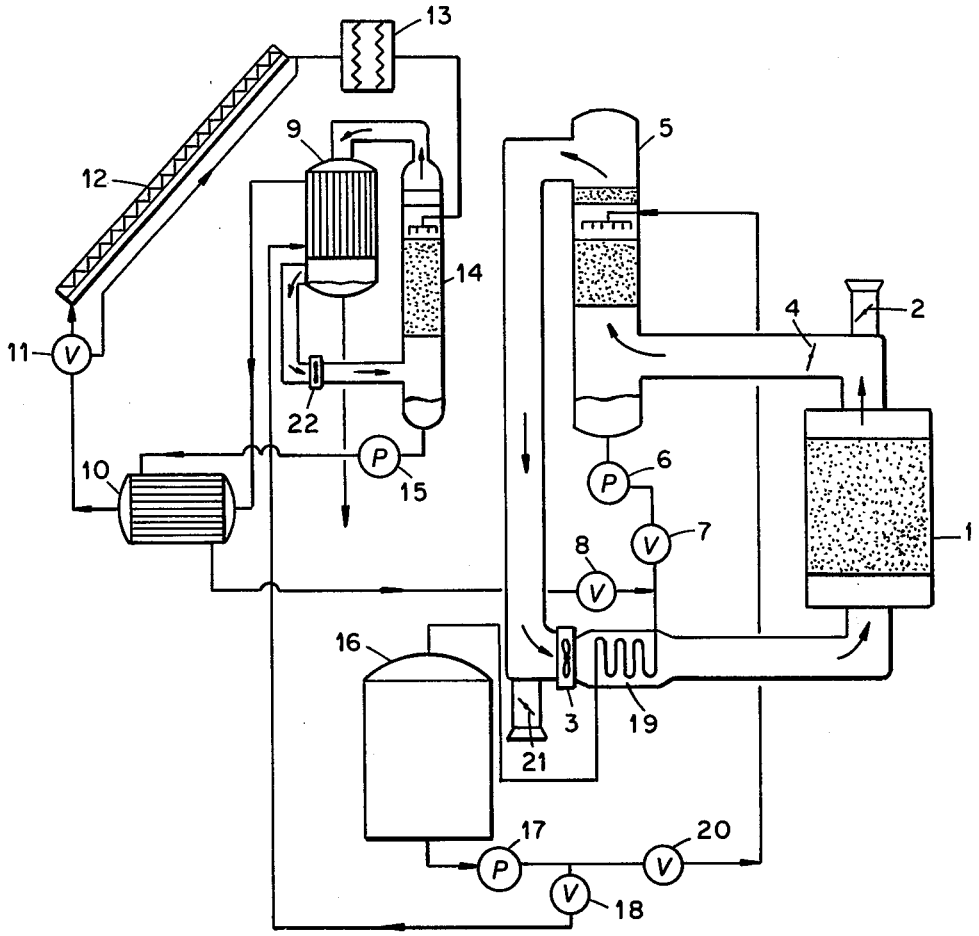
FIG. 4 is a schematic diagram of one embodiment of the present invention utilizing a liquid desiccant to which FIGS. 2*a* and 2*b* relate.
Figure 5:
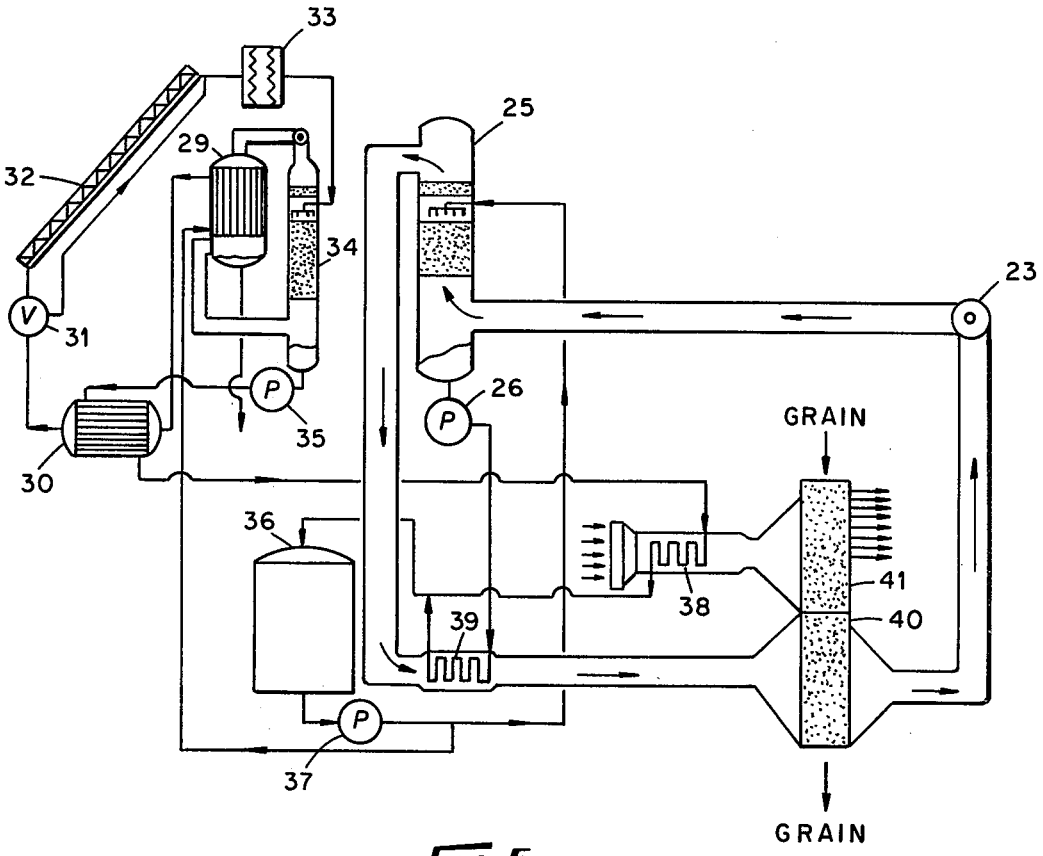
FIG. 5 is a schematic diagram of another embodiment of the present invention which is a modification of the system of FIG. 4 to which FIGS. 3*a* and 3*b* relate.
Figure 6:
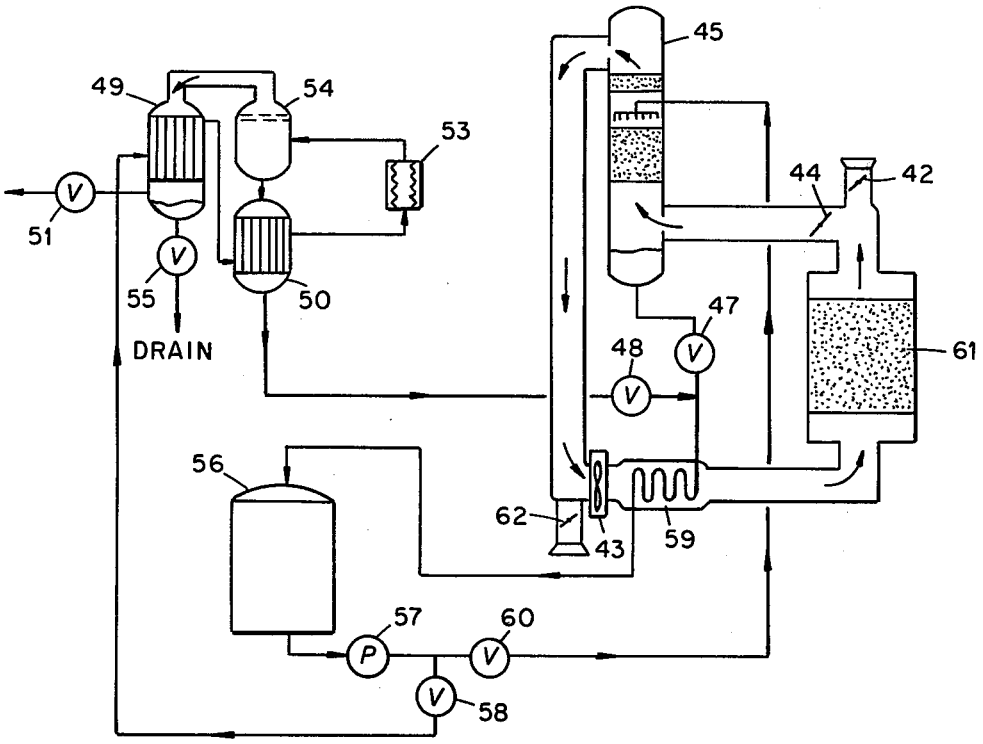
FIG. 6 is a schematic diagram of still another embodiment of the present invention utilizing an evaporator as a desiccant regenerator.

FIGS. 4, 5 and 6 of the drawings illustrate three respective embodiments of the present invention in which a liquid desiccant is utilized, and the details of these various embodiments will now be described.

A schematic diagram of one system of the present invention using liquid desiccants (lithium chloride solution, for example) to dry a crop contained in a drying bin is illustrated in FIG. 4 of the drawings. It should be understood that open cycle drying is effected through the crop bin at the same time as the dilute desiccant is being regenerated in a regeneration loop of the system after which closed cycle drying is effected through the crop bin to complete the total drying cycle of the system.

Regenerated, hot desiccant from a storage tank 16 is continuously fed by means of a pump 17 and a valve 20 to an absorption column 5 positioned in a closed-loop air line with a blower 3, heat exchanger 19, and a crop bin 1. The moist air being moved by the blower 3 from the bin 1 comes into contact with the hot desiccant in the column 5 and is absorbed thereby. The dry air from the column 5 then flows back to the bin 1 through the heat exchanger 19 where it is heated to a temperature of 90° F. and dried to a relative humidity of 40%, for example, prior to its flow through the bin. During this closed cycle operation the valves 8 and 18 are closed since the regeneration loop is not being used at this time.

The desiccant from the column 5 is then pumped by means of a pump 6 through a valve 7 and the heat exchanger 19 back to the storage tank 16. In order to regenerate the desiccant after it becomes saturated (diluted), it is pumped from the storage tank 16 by means of the pump 17 through a valve 18 to a condenser 9, thence through a heat exchanger 10 to a solar heater 12 and then through an electrical heater 13 to a stripping column 14 where the water vapor is drawn off the now hot, dilute desiccant and is then fed through the condenser 9. During regeneration of the dilute desiccant, the valves 7 and 20 are closed and the bin 1 is then coupled in an open-cycle drying mode in a manner to be described hereinbelow. The hto water from the condenser 9 is then fed to a drain. It should be noted that the hot water vapor fed to the condenser 9 preheats the dilute cool desiccant flowing therethrough, and the desiccant is also preheated in the heat exchanger 10 (before passing through the solar unit 12) by the hot regenerated desiccant pumped from the column 14 by a pump 15 to the unit 10 after which the hot desiccant is returned to the storage tank 16 by way of the valve 8 and the heat exchanger 19. A blower 22 is provided which circulates air flow between the regeneration column 14 and the condenser 9.

It should be noted that should the solar unit 12 not be required or desired in the operation of the system then it can be bypassed by means of a valve 11 and the dilute desiccant passed directly to the heater 13.

The crop bin 1 is constructed of plexiglass material, for example, and it is approximately 12 in. in diameter by 42 in. high. Air flow is upward, with the crop to be dried resting on a perforated metal support plate. The bin is removable from the system.

The air ducting is 3 in. i.d. PVC pipe, for example. Nominal air velocity is 6.7 ft/sec. The blower 3 is a squirrel cage unit with a 24 Vdc motor and permits variable speed operation with air for up to 40 cfm for closed cycle drying in which the air valves 2 and 21 are closed and air valve 4 is opened. For open cycle drying, the air valves 2 and 21 are opened and the air valve 4 is closed, and air is drawn in upstream of the blower 3, passes through the heat exchanger 19 and the crop bin 1, and is discharged from the top plenum of the crop bin to the atmosphere.

The absorption column 5 consists of a 24 in. height of 1 in. o.d. Raschig rings cut from PVC pipe. The packing is arranged randomly (dumped) and is supported on a perforated plastic plate giving a 47% flow area, for example.

The inlet desiccant flow to the column 5 is at a rate of 45 pounds per hour at a temperature of 90° F., for example, and is uniformly distributed on the top of the packing and flows down countercurrent to the upward air flow. Just above the desiccant inlet is a demister for ensuring that no air-entrained liquid can pass out of the column and consists of a 3 in. height of packing rings resting on a wire-grid support plate. The bottom of the column 5 provides a 4 in. liquid sump and prevents air from entering the desiccant outflow.

The air/desiccant heat exchanger 19 uses a standard fin/tube core and is mounted integral with the air blower 3. The unit 19 is used for fire control of air temperature during closed cycle drying when the valves 8 and 18 are closed and the valves 7 and 20 are opened, and to heat ambient air during open cycle drying with valves 7 and 20 closed and valves 8 and 18 opened, during which hot regenerated desiccant at a temperature of about 142.5° F., for example, is available from the regeneration loop unit 10 which then passes through the valve 8, through the unit 19 in the air drying loop and then back to the storage tank 16.

The desiccant feed pump 17 supplies desiccant alternately to both the absorber column 5 and to the regeneration column. It is a self-priming variable speed gear-type pump with Teflon gears and 316 stainless steel body and shaft, for example. Maximum flow is 1.5 gpm.

The desiccant storage tank 16 is a 10-gallon cylindrical vessel of Nalgene plastic, for example. Desiccant is withdrawn from the tank 16 through a Tygon suction line with a filter. Desiccant circulation through the regeneration column 14 is about 30 pounds per hour at a temperature of 240° F., for example, and continues during the open cycle drying in the above fashion until the desired amount of water has been removed from the desiccant and the hot regenerated desiccant is ready to be used in the drying loop for closed cycle crop drying as described hereinabove.

The regeneration column 14 is fabricated from 2.9 in. i.d. copper tubing and contains 36 in. of packing consisting of 0.28 in. o.d. by 0.28 in. long glass Raschig rings, for example. A three inch thickness of this packing is also used as a demister located just above the desiccant distributor tube. The column 14 is insulated with 2 in. thick calcium silicate material for minimum heat loss. Overall column height is about 54 in., for example. The outlet temperature of the desiccant flowing from the regeneration column 14 is about 180° F., for example.

The condenser 9 is a conventional shell/tube configuration with the desiccant flowing upward in the shell and the air/water-vapor mixture and condensate flowing downward through 27 copper tubes of 0.375 in. o.d. soldered at the ends. The condenser assembly is also insulated with 2 in. of calcium silicate material.

The blower 22, which circulates air flow between the regeneration column 14 and the condenser 9, as mentioned above, is a small (2 in. impeller) squirrel cage unit and is driven by a variable speed ac motor.

The heat exchanger 10 is a counter flow arrangement consisting of 16 ft. of 0.25 in. o.d. copper tubing within 0.375 in. i.d. Tygon tubing and formed into a 5 in. diameter coil, for example. The coil is mounted within a 6×6 in. plastic enclosure and surrounded by fiberglass insulation. Hot desiccant from the bottom of the regeneration column 14 flows through the annular space between the copper and Tygon tubing.

The desiccant pump 15, used to pump hot desiccant to the drying loop heat exchanger 19, is a small oscillating type pump of 0.1 gpm capacity and driven by 60 Hz voltage pulses.

The electrical heater 13 assembly consists of a Chromalox 750 W copper sheathed immersion heated mounted in a 1.25 in. diameter copper enclosure. The heater is wrapped with 0.060 in. o.d. copper wire to increase the heat transfer area and minimize vapor bubble formation. Insulation for the unit 13 is 1 in. fiberglass covered with aluminum foil.

The desiccant piping (both loops) is primarily 0.25 in. o.d. copper tubing with brass compression fittings, for example.

The solar collector 12 is comprised of 12 individual collector panels arranged in two segments of six panels each. Each panel is an available commercial design having a selectively coated copper absorber plate and two layers of cover glass. The collector is used to furnish a maximum of 44% of the required daily energy input to the regeneration loop, with the majority of the input furnished by the electrical heat source 13. The desiccant is circulated directly through the collector panels without need for a separate transport fluid and associated heat exchanger. For this reason, copper flow passages are a necessity to minimize corrosion effects. To obtain good flow velocity of the desiccant through the collector panels, a parallel/series arrangement is used in which the desiccant first flows through a segment of six parallel panels and then through a second segment of six panels.

In the operation of the system of FIG. 4 to provide for drying of a 1 bu.test crop (1.25 cu. ft. of raw unshelled peanuts, for example) using a liquid chloride desiccant, an 18 hour drying cycle is utilized. Starting with dilute desiccant and a moist crop, the desiccant is regenerated for 6 hours using the recovered thermal energy therefrom in the heat exchanger 19 for open-cycle drying as discussed hereinabove. The drying cycle is then completed during the next 12 hours of closed-cycle operation, as discussed above, in which the remaining water in the crop is absorbed into the desiccant in the column 5. The total water removed from the crop in 18 hours is about 7.07 pounds.

FIG. 5 of the drawings illustrates a modification of the system of FIG. 4, utilizing continuous regeneration of the desiccant wherein grain is initially dried and preheated in a first bin 41 of a two-stage column dryer in a conventional open loop fashion using heat rejected in cooling the hot, regenerated desiccant in a heat exchanger 38, which desiccant is fed to the unit 38 from a heat exchanger 30 during a regeneration of dilute desiccant in the same regeneration manner as in the system of FIG. 4. It should be understood that a blower, not shown, is provided for blowing air through the heat exchanger 38 for the heating and drying thereof before passing through the crop bin 41. The grain then passes into the closed loop portion of the drying scheme, wherein the air flowing therethrough by means of a blower 23 passes through an absorption column 25 where the air is dehumidified and then it is heated in a heat exchanger 39 before passing through a bin 40 of the two-stage column dryer. The components 25, 26, 29–37, and 39 of FIG. 5 operate and function the same as the respective components 5, 6, 9–17, and 19 of FIG. 4 as already described hereinabove. However, additional energy savings are achieved because the thermal energy required to preheat the grain in open loop drying is retained in the closed loop portion as the grain moves continuously from one stage to the next.

FIGS. *2a* and *2b* illustrate schematically the closed cycle drying operation and the absorption loop operation of the system of FIG. 4. FIG. *2a* is for the closed cycle drying and FIG. *2b* shows the corresponding changes in the desiccant concentration and temperature. In the drying bin 1, the drying air picks up the moisture from the crop and is humidified (i.e., A→B in the diagram). The drying process requires energy to drive the moisture from the crop, and this energy is provided by the drying air. Therefore this humidification process follows the adiabatic cooling path on the psychrometric chart. The dehumidification process (i.e., B→C) is an exothermic process, accomplished in the absorption column 5, and hence the air is heated to some extent but not quite back to the drying temperature. Although the absolute humidity is the same for C and A, the air at C must be heated (C→A) to suppress the relative humidity and thereby the cycle is completed. The required energy for this heating is provided by the dilute hot desiccant from the column 5 (i.e., process (b) in FIG. *2b*). The process (b) is a cooling process for the used desiccant. The desiccant is heated in the absorption process (a) from $T_1$ (90° F.) to $T_2$ (100° F.) and the excess sensible energy is used for drying. The absorption process is a transient one due to continuous change in the concentration of the desiccant to the column. $C_1$ is the initial concentration and $C_2$ is the final one when the closed cycle drying operation is completed. The cycle (a')-(b')-(c') represents an intermediate condition when the tank concentration is at $C_3$.

Figure 3A:
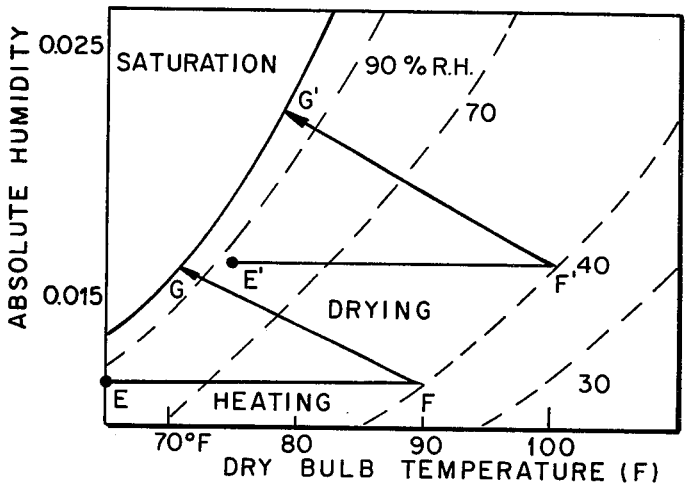
FIG. 3*a* is a graph illustrating the open cycle drying operation of another system of the present invention.
Figure 3B:
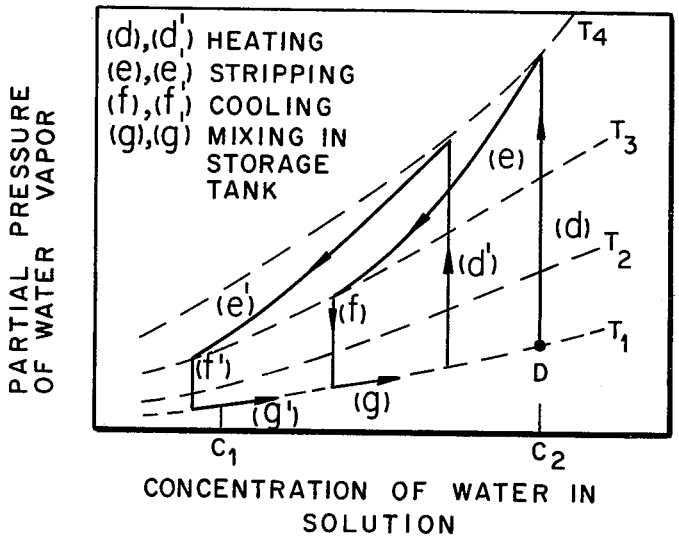
FIG. 3*b* is a graph illustrating the regeneration operation of the desiccant in the system referred to in FIG. 3*a;*

FIGS. *3a* and *3b* illustrate schematically the operation of the open cycle drying and the regeneration operation, respectively, for the system of FIG. 5. The starting condition (D) in FIG. *3b* for the regeneration is typically 37% at 90° F. The process (d) is a heating process to elevate the desiccant temperature to the regeneration temperature, $T_4$, and is accomplished in three steps: (1) heating from $T_1$ to $T_2$ is done in the condenser 29 by recovering heat of varporization; (2) the desiccant is further preheated from $T_2$ to $T_3$ in the heat exchanger 30 using the hot regenerated desiccant stream from the stripping column 34 ($T_3 \rightarrow T_2$ portion of cooling process (f) in the diagram); and (3) the solar collector 32 and the conventional heater 33 are used to heat it from $T_3$ to $T_4$. The thermal energy in this process ($T_3 \rightarrow T_4$) is used in the stripping process (e) to drive out the moisture from the dilute hot desiccant, which results in cooling of the desiccant from $T_4$ to $T_3$. To complete the cycle and to use the regenerated desiccant again as a coolant in the condenser 29 until the tank concentration reaches to the desired level, the temperature of the regenerated stream must be suppressed to the tank temperature, $T_1$. This is performed in two steps: (1) the desiccant is cooled to $T_2$ in the heat exchanger 30 to preheat the dilute desiccant (process (d) $T_2 \rightarrow T_3$) as described earlier, and (2) the desiccant is cooled from $T_2$ to $T_1$, which is accomplished in the heat exchanger 38 to provide dry air for the open cycle drying. The net result is that the energy input to the regeneration system (heating $T_3$ to $T_4$ in (d)) is recovered and is available as the energy output of the regeneration loop in the form of lower quality energy (cooling $T_2$ to $T_1$ in (f)), which can be readily used as an energy source for the open cycle drying. Due to the transient characteristic of the stripping column 34 operation, the cycle is repeated until the tank concentration reaches to $C_1$. The cycle (d')-(e')-(f')-(g') represents an intermediate regeneration cycle. In FIG. 3*a*, the ambient air at E(65° F., 85% R.H., for example) is introduced to the heat exchanger 38 and heated to suppress the relative humidity using the available sensible energy from the regenerated desiccant. The process F to G represents the drying process. In this process, the air is humidified, which follows the adiabatic cooling path on the psychrometric chart, and is expended to the atmosphere at almost saturated condition. The process E'-F'-G' is basically the same as the E-F-G path except that the ambient temperature at E' is higher than that of E.

It should be understood that the system of FIG. 5 could be modified, if desired, to utilize two separate drying bins each containing a crop to be dried with one bin in the closed loop air line with the absorption column and the other bin located in the open loop air line, and that a separate desiccant tank could be provided with such a tank coupled between the desiccant outlet from the absorption column and the condenser of the regeneration loop. With such an arrangement, the regenerated hot desiccant can then be pumped through the heat exchanger 39 in the closed loop air line, then through the heat exchanger 38 in the open loop air line to the absorption column, and thence to the separate desiccant tank. Thus, two crops can be dried at the same time with such a modified system.

A third system, not illustrated, for using liquid desiccants combines crop drying with some other thermal energy use. A good example is the processing of soybeans. Soybean processing facilities currently use large amounts of energy both for drying and processing the beans into oil and high protein meal. In such a system, the process thermal energy used for tempering, cooking and evaporating hexane (used to separate the oil from the meal) could be obtained from the thermal energy available in the regeneration of the desiccant in a manner similar to the system of FIG. 4 or FIG. 5. The net result of this arrangement is that drying and processing of the soybeans can be accomplished with about 14% of the conventional energy requirements for soybean drying.

The results of three process analyses using liquid desiccants ($CaCl_2$ or LiCl solutions) are shown in the following table compared with conventional open cycle dryers.

TABLE

COMPARISON OF DIFFERENT DRYING SCHEMES

| Case/Description | | Btu/lb $H_2O$ Removed | Frac. of Energy used Compared with Conventional |
|---|---|---|---|
| 1. Desiccant - | 1 crop drying bin (2 mode drying) | 1100 | 0.50 |
| 2. Desiccant - | 2 stage drying (single bin or continuous) | 1000 | 0.45 |
| 3. Desiccant - | 1 stage drying with non-drying energy use | 300 | 0.14 |
| 4. Conventional - | Open cycle crop drying | 2210 | 1.00 |

The three desiccant cases represent three different ways of using the energy recovered during the regeneration cycle, namely: 1 crop bin, two-mode drying (FIG. 4 or FIG. 6 to be described hereinbelow), two stage drying (FIG. 5), and alternate non-drying energy use for rejected thermal energy. The results shown are in the form of the total energy required to remove 1 pound of water from a crop (peanuts in this case). Both thermal energy and electrical energy (for pumps and blowers) are included in the totals.

FIG. 6 illustrates still another embodiment of the present invention for crop drying in which a liquid desiccant is utilized. The system of FIG. 6 operates in substantially the same manner as the system of FIG. 4, with the exception that an evaporator is utilized in the desiccant regeneration loop instead of a stripping column. During the regeneration of the dilute desiccant, the system of FIG. 6 is operated in the open cycle drying mode (first six hours) wherein the valves 47 and 60 are closed, the air valves 42 and 62 are opened, the air valve 44 is closed, and ambient air is blown through a crop bin 61 by means of a blower 43 after passing through a heat exchanger 59 which is in the regeneration loop at this time. During the open cycle drying mode, dilute desiccant is pumped from its storage tank 56 by means of a pump 57 through a valve 58 to a condenser 49 and thence to a heat exchanger 50. The dilute desiccant is preheated in the units 49 and 50 before it is passed through a heater 53 (solar or fossil or a combination thereof). The finally heated dilute desiccant is then fed to an evaporator 54 where the water vapor in the desiccant is driven off and is then condensed in the condenser 49 before passing to a drain through a valve 55. The now hot, dry regenerated desiccant then passes through the heat exchanger 50, through a valve 48 and the heat exchanger 59 (utilized for the open-cycle drying operation) and then back to the storage tank 56. After the desiccant has been completely regenerated, then the valves 48 and 58 are closed, the valves 47 and 60 are then opened, the air valves 42 and 62 are closed, the air valve 44 is opened, and then for the next 12 hours, the desiccant from the tank 56 is pumped by the pump 57 through the valve 60 to the absorption column 45 and thence through the valve 47 and through the heat exchanger 59 back to the tank 56 in a continuous manner, thus constituting the closed-cycle portion of the complete drying cycle. It should be noted that the non-condensables are removed from the condenser 49 by means of an evacuating means, not shown, by way of a valve 51.

Analysis of the chemical and phsyical properties of desiccants indicates that calcium chloride and lithium chloride salt solutions, as discussed hereinabove, have the best application in solar regenerated desiccant crop drying apparatus. These solutions can be regenerated at lower temperatures than other desiccants (which relaxes constraints on the choice of solar collector hardware), have high specific heats (which augments thermal storage capacity), and are stable, nontoxic chemicals.

The present invention has been described by utilizing a liquid desiccant in the respective embodiments thereof. However, it should be understood that a solid desiccant (silica gel, for example) could be utilized if such were desired. In such a system two beds containing a solid desiccant, and a drying bin could be provided wherein one desiccant bed is coupled to the drying bin in a closed loop fashion while at the same time the other desiccant bed is being regenerated after which the regenerated bed is coupled to the drying bin and the first bed can then be regenerated, etc.

This invention has been described by way of illustration rather than by limitation and it should be apparent that it is equally applicable in fields other than those described.

What is claimed is:

1. A method of drying a crop comprising the steps of continuously passing a regenerated, liquid desiccant from a storage tank through an absorption column and then through a first heat exchanger back to said tank; passing hot, dry air through a crop bin containing said crop for absorbing moisture therefrom; passing the moist exit air from said bin to said absorption column containing said regenerated, liquid desiccant for removing the moisture from said moist air; passing the exit air from said absorption column through said first heat exchanger for the heating and drying of said air before it is again passed through said bin in a closed-loop fashion; removing said desiccant from said storage tank after it becomes used and saturated with moisture and regenerating it comprising the steps of passing it through a condenser for preheating thereof, through a second heat exchanger for further preheating therof, and through heating means for regenerating (further heating) said saturated desiccant; then passing said regenerated desiccant exiting from said heating means through means for separating the water vapor therefrom; passing said separated water vapor through said condenser where it is condensed to water and passed to a drain, said water vapor being condensed in said condenser serving as an energy recovery mechanism to provide for said preheating of said saturated desiccant passing therethrough to said heating means, passing the now dry, hot, regenerated desiccant from said moisture separating means through said second heat exchanger for said further preheating of said saturated desiccant prior to its passing through said heating means and passing the regenerated, dry desiccant exiting from said second heat exchanger to said desiccant storage tank, and repeating all of said steps as many times as necessary to dry said crop to a desired dryness.

2. The method set forth in claim 1, wherein said heating means is a solar collector and an electrical heater connected in series between said second heat exchanger and said moisture separating means, said regenerated, hot, dry desiccant exiting from said second heat exchanger is passed through said first heat exchanger before being passed to said storage tank, and further including the steps of passing ambient air through said first heat exchanger for the heating and drying thereof and then through said crop bin to the atmosphere in an open loop fashion while at the same time the passing of said desiccant through said absorption column is stopped during the time said saturated desiccant is being regenerated and said crop bin is supplied drying air in said open loop fashion.

3. The method set forth in claim 2, wherein said liquid desiccant is a lithium chloride solution and said moisture separating means is a stripping column.

4. The method set forth in claim 2, wherein said liquid desiccant is a lithium chloride solution and said moisture separating means is an evaporator.

5. The method set forth in claim 1, wherein said crop bin is an open-ended, two-stage column dryer of two stacked bins through which grain to be dried is continuously passed, said regenerated hot, dry desiccant exiting from said second heat exchanger is passed through a third heat exchanger before being passed to said storage tank, and further including the steps of passing ambient air through said third heat exchanger for the heating and drying thereof and then passing it through a first bin of said two-stage column dryer in an open-loop fashion for preheating the grain passing through said first bin, further drying said grain exiting from said first bin in a second bin of said two-stage column dryer as said grain passes therethrough by the hot dry air from said first heat exchanger which air is passed through said second bin in said closed-loop fashion, wherein said bins are supplied with drying air in a continuous manner and said used desiccant is regenerated in a continuous manner.

6. The method set forth in claim 5, wherein said moisture separating means is a stripping column, said heating means is a solar collector and an electrical heater connected in series between said second heat exchanger and said stripping column.

7. The method set forth in claim 6, wherein said liquid desiccant is a lithium chloride solution.

* * * * *